US005570824A

United States Patent [19]

Lyon et al.

[11] Patent Number: 5,570,824

[45] Date of Patent: Nov. 5, 1996

[54] BELT PACK AND SUPPORT THEREFOR

[76] Inventors: Scott B. Lyon; Bruce W. Lyon, both of P.O. Box 139, Norfolk, Conn. 06058

[21] Appl. No.: 433,314

[22] Filed: May 3, 1995

[51] Int. Cl.[6] ..... A45F 5/00

[52] U.S. Cl. ..... 224/240; 224/665; 224/674; 224/662; 224/675; 224/678; 224/242; 224/148.5; 224/901.8; 224/930

[58] Field of Search ..... 224/148, 151, 224/153, 209, 215, 224, 226, 240, 242, 250, 253, 222, 901, 660, 662, 663, 665, 671, 672, 673, 674, 675, 676, 678, 680, 681, 901.2, 901.4, 901.8, 148.5, 148.6

[56] References Cited

U.S. PATENT DOCUMENTS

| | | | |
|---|---|---|---|
| D. 238,725 | 2/1976 | Zerobnick et al. . | |
| D. 259,151 | 5/1981 | Kishbaugh et al. . | |
| D. 261,196 | 10/1981 | Griffin . | |
| 1,382,446 | 6/1921 | Warren | 224/222 |
| 3,664,560 | 5/1972 | Perkins | 224/226 |
| 4,029,243 | 6/1977 | Zerobnick et al. . | |
| 4,174,793 | 11/1979 | Wisowaty | 224/240 |
| 4,345,704 | 8/1982 | Boughton . | |
| 4,401,245 | 8/1983 | Zills | 224/148 |
| 4,449,654 | 5/1984 | Cappis . | |
| 4,523,703 | 6/1985 | McKenna . | |
| 4,569,465 | 2/1986 | O'Farrell . | |
| 4,779,655 | 10/1988 | Olson . | |
| 4,802,602 | 2/1989 | Evans et al. . | |
| 4,819,846 | 4/1989 | Hannemann . | |
| 4,834,274 | 5/1989 | Johnson . | |
| 4,836,428 | 6/1989 | Evans et al. | 224/240 |
| 4,871,597 | 10/1989 | Hobson . | |
| 4,898,310 | 2/1990 | Remington . | |
| 4,901,899 | 2/1990 | Barrett . | |
| 4,907,729 | 3/1990 | Hess, III . | |
| 5,012,964 | 5/1991 | Falletta et al. | 224/209 |
| 5,045,979 | 9/1991 | Stevens . | |
| 5,048,734 | 9/1991 | Long | 224/901 |
| 5,060,835 | 10/1991 | Payne . | |
| 5,121,865 | 6/1992 | Howard . | |
| 5,150,824 | 9/1992 | Alvarez et al. . | |
| 5,169,043 | 12/1992 | Catania . | |
| 5,205,448 | 4/1993 | Kester et al. | 224/240 |
| 5,209,385 | 5/1993 | Ledesma . | |
| 5,228,609 | 7/1993 | Gregory | 224/224 |
| 5,240,156 | 8/1993 | Sicotte et al. | 224/240 |
| 5,263,618 | 11/1993 | Talavera | 224/901.4 |
| 5,395,023 | 3/1995 | Naymark et al. | 224/240 |
| 5,413,262 | 5/1995 | Dewire et al. | 224/215 |
| 5,419,473 | 5/1995 | Lamar | 224/215 |

*Primary Examiner*—Henry J. Recla
*Assistant Examiner*—Gregory M. Vidovich
*Attorney, Agent, or Firm*—Trexler, Bushnell, Giangiorgi & Blackstone, Ltd.

[57] ABSTRACT

A novel belt pack system includes a pack having an adjustable length belt attached thereto. An adjustable length, three-point stabilizer strap arrangement is connected to each side of the pack and belt. A water bottle and its associated carrier, a carrier for carrying items such as a cassette tape player or the like and/or a fold-up bag can be attached to the belt. The belt has a fastener material, such as known hook and loop material or other means such as snaps and the like, on a surface thereof. The pack has a first, main compartment which is large enough to hold a pair of shoes and a smaller compartment which is separated from the main compartment for carrying keys, a shirt, etc. When worn, the belt extends around the waist of a wearer and the pack abuts the wearer's small of the back. The pack may include an outer compartment formed of a mesh material which is separated from the interior compartments by an outer wall of the pack. Each of the water bottle carrier, the carrier and the fold-up bag include complementary fastener material, such as hook material thereon for attaching the items to the loop material on the belt. When the bag is detached from the belt and unfolded, the fold-up bag is large enough to hold a pair of in-line skates or ski boots.

14 Claims, 4 Drawing Sheets

BELT PACK AND SUPPORT THEREFOR

BACKGROUND OF THE INVENTION

This invention is generally directed to a novel belt pack system for carrying items, such as a pair of shoes or the like, a shirt, keys, cassette tape players, a water bottle, etc. More particularly, the invention contemplates a belt pack system which can have a carrier for holding a water bottle (herein "water bottle carrier"), a carrier for carrying a cassette tape player or the like (herein "cassette tape player carrier") and/or a fold-up bag selectively attached to an adjustable length belt which, when worn, encircles a wearer's waist. An adjustable length, three-point stabilizer strap arrangement is attached to each side of the pack and the belt for providing stability to the system. The belt has a quick release fastener material on a surface thereof and the water bottle carrier, the cassette tape player carrier and the fold-up bag each have complimentary fastener material thereon for attachment to the belt. Such fastener material may be known as hook and loop material commercially available under the trademark Velcro® or other means such as snaps and the like. Alternatively, the items may be attached to other straps on the system. The fold-up bag, when detached from the belt and unfolded, is large enough to hold a pair of in-line skates, ski boots or the like.

In-line skating and skiing have become increasingly popular in the United States and around the world. A problem that arises with in-line skating or skiing is that most stores, restaurants and the like will not allow a patron to wear in-line skates or ski boots on the premises. Thus, a skater or skier must carry his or her shoes with them if they intend on patronizing the store or restaurant so that they can change into shoes before entering the premises.

In order to carry their shoes, skaters and skiers sometimes wear a backpack which has straps that encircle their shoulders. The backpack usually sits relatively high up on their back and can cause balance problems for the skater or skier, especially a novice. Furthermore, the backpack tends to restrict the wearer's arm movements and can easily slip off of their shoulders unless the straps are firmly tightened therearound.

The present invention presents a novel belt pack system that securely fits around a wearer's waist and fits snugly against the small of the back of the wearer. The belt pack of the present invention overcomes or minimizes problems found in or inherent in the prior art as well as presenting several advantages over the prior art as discussed herein.

OBJECTS AND SUMMARY OF THE INVENTION

A general object of the present invention is to provide a novel belt pack system that includes a pack, a belt which can be attached to the pack and may include a water bottle carrier, a cassette tape player carrier and/or a fold-up bag which can be selectively attached to the belt.

An object of the present invention is to provide a belt pack system that is worn around the waist of a wearer and does not interfere with the wearer's arm movements or balance.

Another object of the present invention is to provide a pack for use in a belt pack system that includes a pair of adjustable length, three-point stabilizer strap arrangements for stabilizing the system and for firmly and securely holding the pack against the small of the back of the wearer.

Briefly, and in accordance with the foregoing, the present invention discloses a belt pack system which includes a pack with an adjustable length belt attached thereto. The belt attaches to the rear wall of the pack and extends rearwardly therefrom. When the pack is worn, the belt encircles the waist of a wearer and the pack abuts against the wearer's small of the back. An adjustable length, three-point stabilizer strap arrangement is connected to each side of the pack and the belt to provide for stability in the system.

A water bottle and its associated carrier, a cassette tape player carrier and/or a fold-up bag can be attached to the belt or alternatively, to a compression strap which encircles the front of the pack. The bag is also selectively attachable to the belt or strap when folded. The belt has a quick release loop fastener material on a surface thereof and the water bottle carrier, the cassette tape player carrier and the fold-up bag each have a complementary hook fastener material thereon for selectively attaching the items to the loop material on the belt. Such fastener material may be known as hook and loop material, commercially available under the trademark Velcro®; or other means such as snaps and the like. When the fold-up bag is detached from the belt and unfolded, the bag is large enough to hold a pair of in-line skates, ski boots or the like.

The pack has a first compartment therein which is large enough to hold a pair of shoes or the like and a second, smaller compartment therein which is separated from the first compartment for holding other items, such as keys, a shirt or the like. The pack may include an outer compartment formed of a mesh material which is separated from the interior compartment by an outer wall of the pack. A lumbar pad may be attached the belt to provide support for the wearer's lower back.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
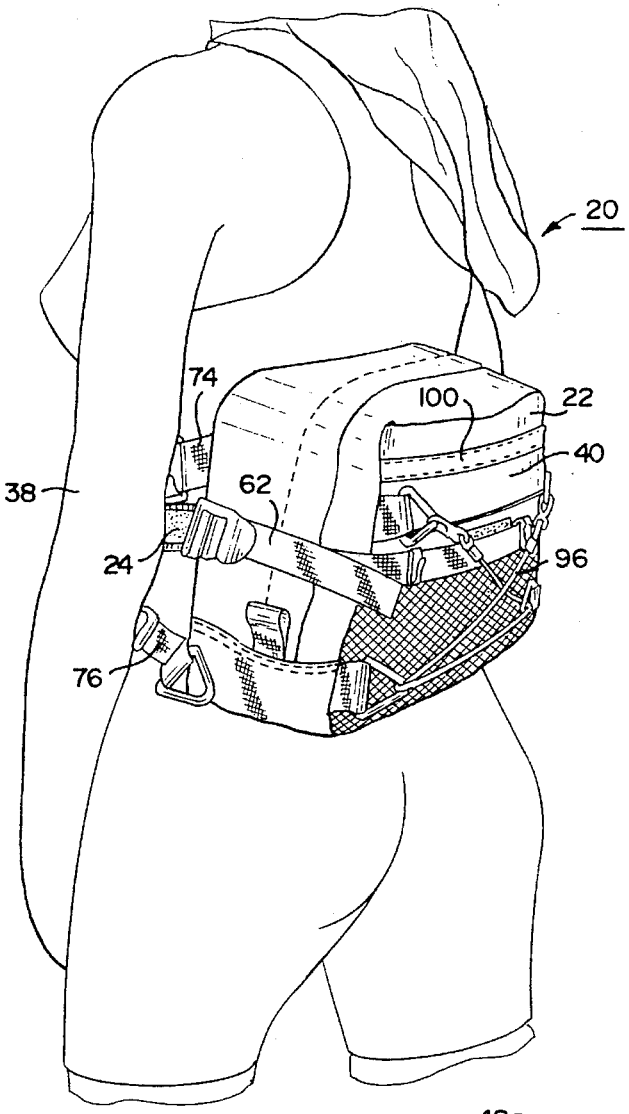
FIG. 1 is a perspective view of a belt pack which comprises a component of a belt pack system and incorporates features of the present invention being worn by a wearer.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 5:
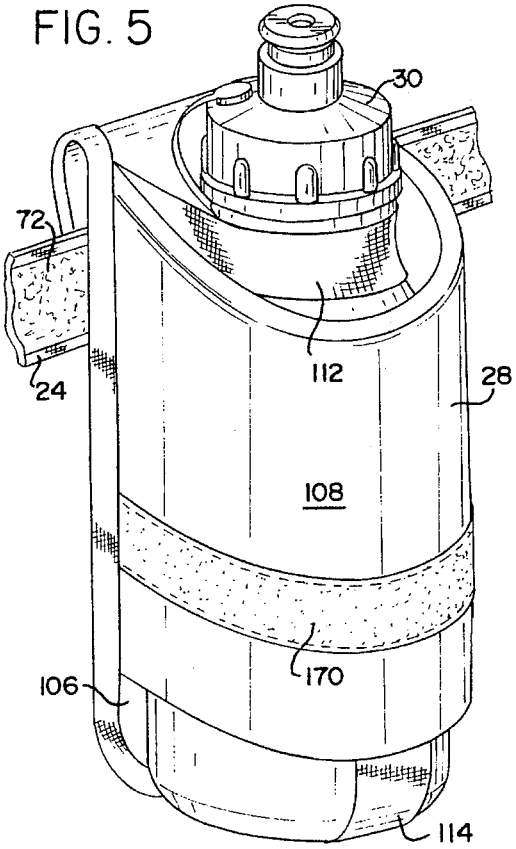
FIG. 5 is a front perspective view of a water bottle and carrier which may be a component of the belt pack system and which may be attached to the belt pack shown in FIG. 1.
Figure 6:
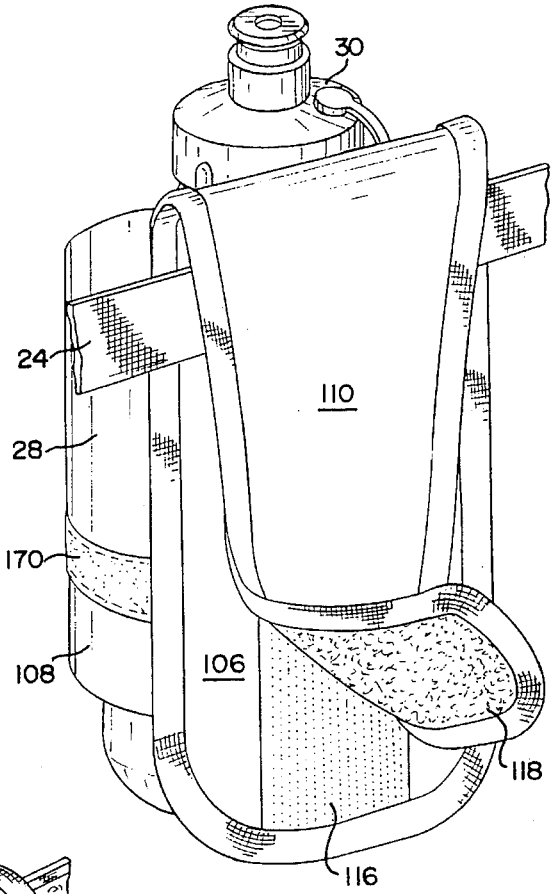
FIG. 6 is a rear perspective view of the water bottle and carrier of FIG. 5.
Figure 7:
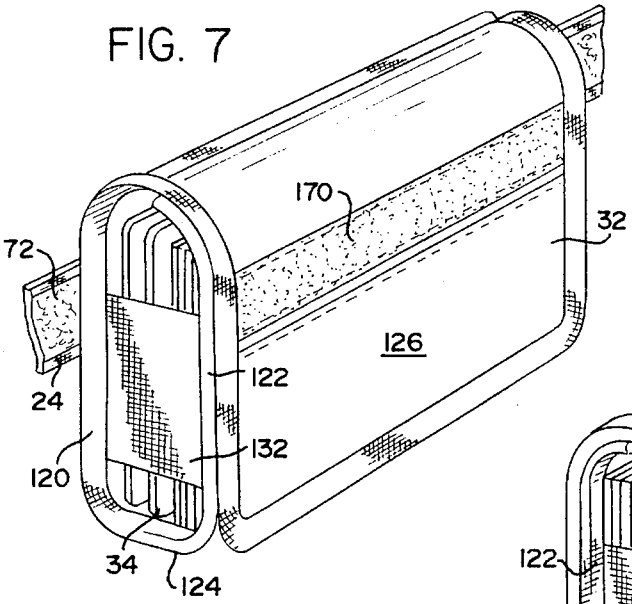
FIG. 7 is a front perspective view of a cassette tape player carrier which may be another component of the belt pack system and which may be attached to the belt pack shown in FIG. 1.
Figure 8:
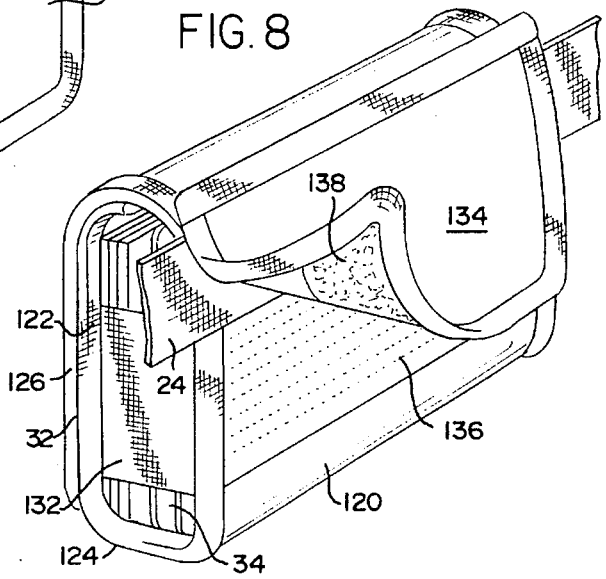
FIG. 8 is a rear perspective view of the cassette tape player carrier of FIG. 7.

As shown in the drawings, the belt pack system 20 of the present invention includes a pack 22, shown in FIGS. 1–4, which has an adjustable length belt 24 extending therefrom. A three-point stabilizer strap arrangement 26 is connected to each side of the pack 22 and the belt 24. A carrier 28 for a water bottle 30 (herein "water bottle carrier"), as shown in FIGS. 5 and 6, a carrier 32 for carrying a cassette tape player 34 or the like (herein "cassette tape player carrier"), as shown in FIGS. 7 and 8, and/or a fold-up bag 36, as shown in FIGS. 9–13, can be selectively attached to the belt 24 as explained in detail herein. While the carrier 32 is referred to as a cassette tape player carrier, it is to be understood that a variety of items can be held in the carrier 32 other than a cassette tape player, such as portable radios, additional cassette tapes, etc. The pack 22, belt 24, stabilizer straps 26, carriers 28, 32, fold-up bag 36 and the associated items are made of a durable, lightweight material, such as nylon.

When worn by a wearer 38, the pack 22 abuts against the small of the wearer's back. The belt 24 extends around the wearer's waist and holds the pack 22 snugly and firmly against the wearer's back. The three-point stabilizer strap arrangement 26 on each side of the pack 22 stabilizes the system 20.

Figure 2:
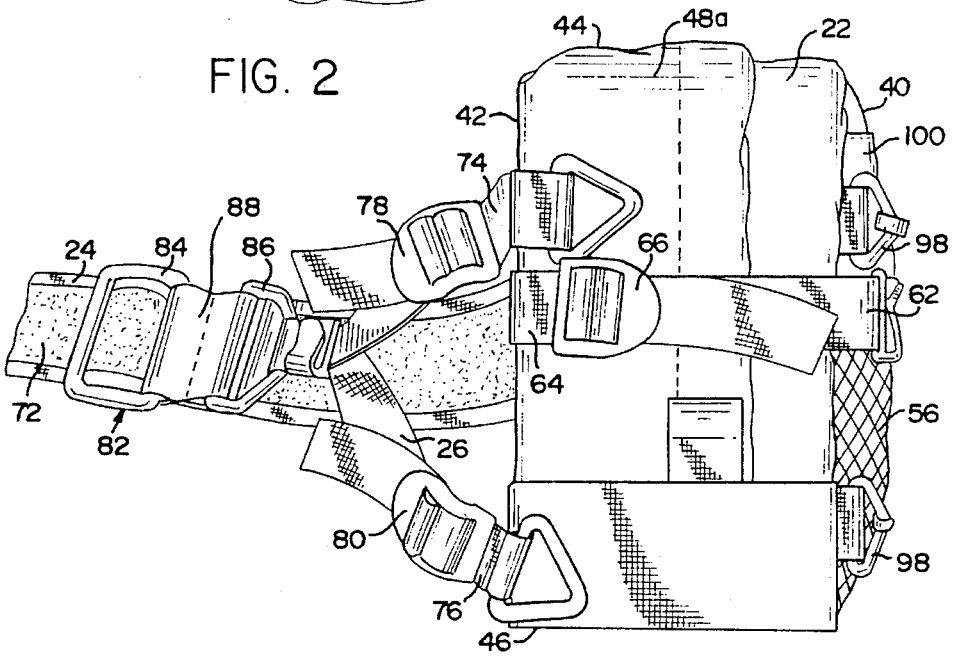
FIG. 2 is a side elevational view of the belt pack of the present invention.
Figure 3:
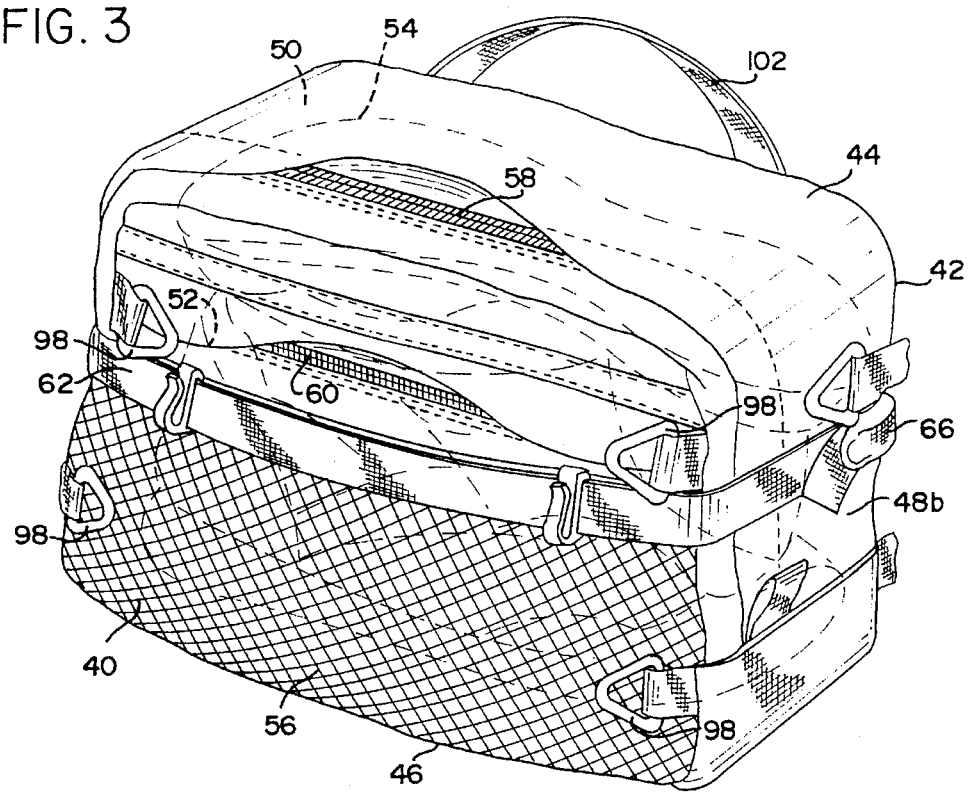
FIG. 3 is a perspective view of the belt pack of the present invention with shoes therein shown in phantom lines.
Figure 4:
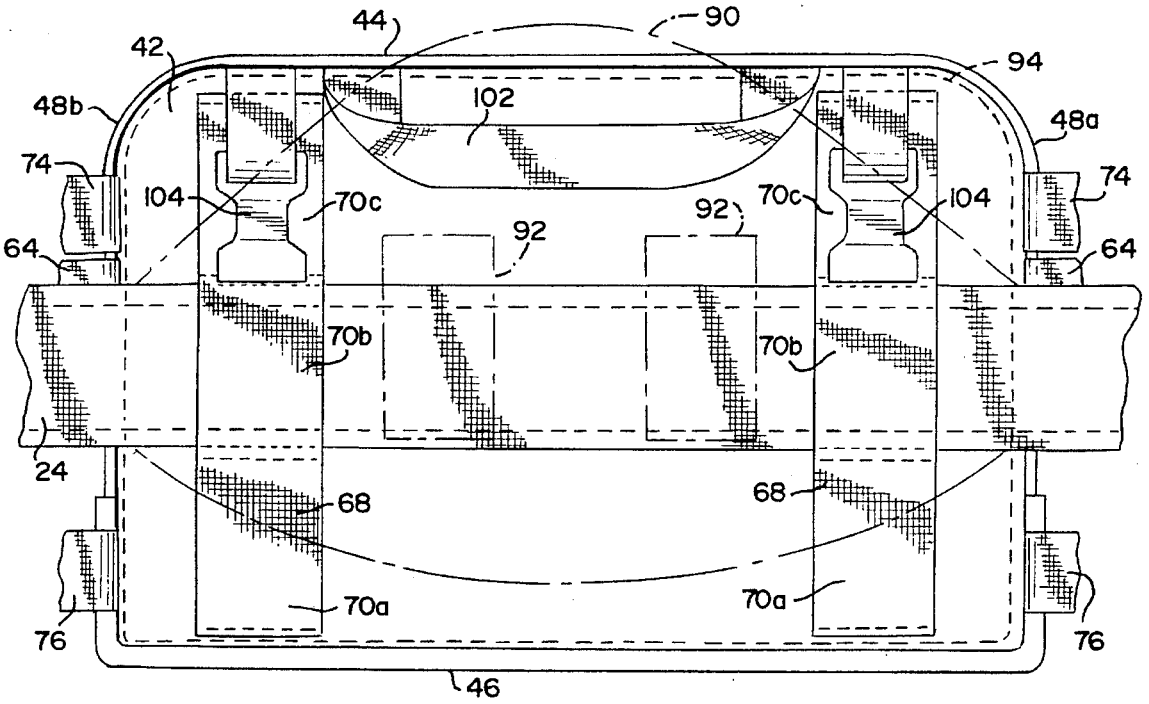
FIG. 4 is a rear elevational view of the belt pack of the present invention with a lumbar pad shown attached thereto and in phantom lines.

The pack 22 of the present invention, shown in detail in FIGS. 2–4, has a front wall 40, a rear wall 42, a top wall 44, a bottom wall 46 and side walls 48*a*, 48*b* to form an enclosed pack. The side walls 48*a*, 48*b* separate the front and rear walls 40, 42 and separate the top and bottom walls 44, 46.

The pack 22 has a first compartment 50 and a second compartment 52 therein. The first compartment 50 is large enough to hold a pair of shoes 54 or the like therein as shown in FIG. 3. The second compartment 52 is smaller and is separated from the first compartment 50 by a sheet of material. The smaller compartment 52 can be used to carry a variety of items, such as keys, a shirt, etc. The first and second compartments 50, 52 can include smaller subcompartments (not shown) therein.

The pack includes a third, outer compartment 56 made by a wall of mesh material. The mesh outer wall 56 is separated from the first and second compartments 50, 52 by the front wall 40 of the pack 22. The mesh wall 56 is fixedly attached to the front wall 40 at the point where the front wall 40 meets the side walls 48*a*, 48*b* and the bottom wall 46. The mesh wall 56 can be opened along its top portion. The top portion of the mesh wall 56 is attached to the front wall 40 by suitable quick release fastener means, such as that known as hook and loop material commercially available under the trademark Velcro® which selectively attaches to an associated piece or patch of complementary fastener material on the front wall of the pack.

The first compartment 50 can be opened along a suitable closure, such as a zipper 58. The zipper 58 for the first compartment 50 extends from approximately the midpoint of one side wall 48*a* along the juncture between the side wall 48*a* and the front wall 40, across the top wall 44 along the juncture between the top wall 44 and the front wall 40 to approximately the midpoint of the other side wall 48*b* along the juncture between the side wall 48*b* and the front wall 40. When the closure 58 is completely opened, the first compartment 50 is opened widely to allow for easy access for a wearer 38 to insert items into the compartment 50.

The second compartment 52 is also be opened along a suitable closure, such as a zipper 60. The zipper 60 for the second compartment 52 extends across approximately the midpoint of the front wall 40 thus dividing the front wall 40 into two sections. The closure for the mesh wall 56 is beneath the closure 60 for the second compartment 52 so that the mesh wall 56 does not interfere with the wearer's 38 ability to easily open the second compartment 52.

The pack 22 also includes an adjustable length compression strap 62 which extends across the front wall 40 of the pack 22. Short straps 64 are fixedly attached to the marginal portions of the rear wall 42 at generally the midpoint of the rear wall 42. A conventional connecting/adjusting member 66, such as a ladder buckle, is attached to the end of the short straps 64. The ends of the compression strap 62 are connected to the ladder buckles 66 and the compression strap 62 extends therefrom along generally the midpoint of the side walls 48*a*, 48*b* of the pack and along generally the midpoint of the front wall 40 of the pack 22. The ladder buckles 66 allow the wearer 38 to tighten or loosen the compression strap 62 around the pack. When the pack 22 has contents therein, such as the wearer's shoes 54, the compression strap 62 is tightened around and compresses the contents within the pack 22 to prevent the contents of the pack 22 from shifting during movement by the wearer 38. As shown in FIG. 3, the tightened compression strap 62 applies pressure to both shoes 54 contained within the pack 22 thereby preventing the shoes 54 from shifting during movement by the wearer 38.

The belt 24 is attached to the rear wall 42 of the pack 22 and can be detached therefrom. The rear wall 42 of the pack 22 includes strips of material 68 sewn thereto to provide for belt loops 70*a*, 70*b*, 70*c*. As shown, each strip of material 68 provides three belt loops to allow the wearer 38 to position the belt 24, and thus the pack 22, at a comfortable position on the wearer's lower back. To attach the belt 24 to the pack 22, the belt 24 is laced through a belt loop, for example 70*b*, on each strip of material 68. While strips of material 68 are shown to provide for the belt loops 70*a*, 70*b*, 70*c*, it is to be understood that other suitable attaching means may be used.

The belt 24 completely encircles the wearer's waist when the pack 22 is worn. The ends of the belt 24 are attached to a suitable, conventional connecting member (not shown), such as a snap-hook connector, for connecting the two ends of the belt 24 together. The connecting member includes a conventional adjustment member for allowing a wearer 38 to adjust the length of the belt 24 around the wearer's waist. The belt 24 has a suitable quick release fastener means 72, such as known hook and loop material commercially available under the trademark Velcro®, along an outer surface thereof for attaching the water bottle carrier 28, the cassette tape player carrier 32 and/or the fold-up bag 36 thereto as explained in detail hereinbelow.

The novel, adjustable length, three-point stabilizer strap arrangement 26 attaches to the belt 24 and the pack 22 and can be detached therefrom. A three-point stabilizer strap arrangement 26 is provided on each side of the pack 22 and extends rearwardly therefrom as described herein. To attach the three-point stabilizer strap 26 to the pack 22, suitable means are provided. As shown in FIG. 2, a first short strap 74 is fixedly attached to an upper marginal portion of the rear wall 42 of the pack 22 on each side of the rear wall 42. A second short strap 76 is fixedly attached to a lower marginal portion of the rear wall 42 of the pack 22 on each side of the rear wall 42. A conventional attachment member 78, 80, such as a ladder buckle, is attached to each free end of the short straps 74, 76.

Each three-point stabilizer strap 26 has a first end which is attached to the ladder buckle 78 at the upper marginal portion and a second end which is attached to the ladder buckle 80 at the lower marginal portion. The attachment members 78, 80 allow the wearer 38 to adjust the length of the three-point stabilizer straps 26 or alternatively, allows the wearer 38 to detach the stabilizer straps 26 from the pack 22. When the stabilizer strap 26 is properly fitted, for maximum comfort and stability, a minimum of free strap should extend outwardly from the ladder buckles 78, 80.

A first plastic member 84 is slidably attached to the belt 24. As shown in FIG. 2, a second plastic member 86 is attached to the first plastic member 84 by a short strap 88. The three-point stabilizer strap 26 is looped through the second plastic member 86 to attach the stabilizer strap 26 to the belt 24.

Now that the specifics of the belt 24 and the three-point stabilizer strap arrangements 26 have been set forth, the procedure for properly attaching the belt 24 and the stabilizer strap 26, and thus the pack 22, around a wearer's waist and for properly adjusting the straps 24, 26 will be described. First, the wearer 38 attaches the belt 24 by looping the belt 24 through the belt loops, for example **70*b*, on the rear wall 42 of the pack 22. The three-point stabilizer straps 26 are attached to the belt 24 as assemblies 82. One assembly 82, which includes the plastic member 84, the short strap 88, the plastic member 86, and the stabilizer strap 26 is looped onto the belt 24 on each side of the pack 22. Once positioned on the belt 24, the free ends of the stabilizer strap 26 are looped through their corresponding ladder buckles 78, 80, leaving a minimal amount of free strap extending outwardly of the ladder buckles 78, 80. The wearer 38 then encircles his or her waist with the belt 24. The belt 24 is adjusted to a comfortable fit by adjusting the belt 24 at the adjustment member to lengthen or shorten the belt 24 so that the belt 24 fits snugly around the wearer's waist. Next, each member 84 is pulled toward the wearer's front by sliding the plastic member 84 forward to a comfortable position. Thereafter, the wearer 38 pulls the free ends of the stabilizer straps 26 which extend outwardly from the ladder buckles 78, 80 until the stabilizer straps 26** are generally taut.

When the three-point stabilizer straps 26 are properly adjusted, the pack 22 is securely fitted around the wearer's waist and sits snugly against the wearer's small of the back. The three-point stabilizer straps 26 provide stability to the system 20 and also bears a portion of the load to prevent excessive stress at the belt loops **70*a*, 70*b*, 70*c* on the rear wall 42 of the pack 22**.

The pack 22 of the present invention can include a pad 90 of known structure, as shown in phantom outline in FIG. 4, attached to the belt 24 by suitable known means. As shown in FIG. 4, the pad 90 includes mounting flaps 92 which overlay the belt 24. The flaps 92 have Velcro® material on the side which faces the belt 24 for attachment to the Velcro® material 72 on the exterior, i.e. the surface not in contact with the wearer, surface of the belt 24. When worn, the pad 90 abuts the small of the wearer's back to provide lumbar support in the lower back.

The pack 22 can also include a flat, thin, lightweight member 94, as shown in phantom outline in FIGS. 3 and 4, made of a relatively stiff material, such as cardboard or plastic. The member 94 is adjacent to the rear wall 42 of the pack 22 and prevents the pack 22 from collapsing.

The pack 22 may include several other features. As shown in FIG. 1, the pack 22 may have a flexible cord 96, such as a bungee cord, attached thereto by suitable plastic members 98 attached to the front of the pack 22. The bungee cord 96 is not shown in FIG. 3 for clarity. As shown in FIG. 1, the pack 22 can have reflective strips of material 100 attached thereto to aid a passerby in seeing the wearer 38. The pack 22 can include a bail handle 102 on the top, as shown in FIG. 4, so that the pack 22 can be carried by hand. Also, as shown in FIG. 4, the pack 22 can include release buckles 104 to which a shoulder strap of known structure can be attached.

The novel pack 22 of the present invention presents several advantages over prior art backpacks. Since the pack 22 fits firmly against the small of the back of the wearer 38 and not up on the wearer's upper back and/or shoulders, the wearer's upper body movements are not restricted. Furthermore, since the pack 22 sits against the small of the back near the wearer's center of gravity, the effect of pack 22 on the wearer's balance is minimal.

In FIGS. 5 and 6, the water bottle 30 and its associated water bottle carrier 28 are shown. The water bottle carrier can be selectively attached to the belt 24. The water bottle 30 is of a known construction and is not described herein. The water bottle carrier 28 has a flat back portion 106 with a hold portion 108 extending outwardly therefrom. The hold portion 108 is complimentarily shaped to conform with the water bottle 30. A flap portion 110 overlays the back portion 106 of the carrier 28.

As shown in FIG. 5, an elastic band 112 is attached to the front surface of the back portion 106 of the water bottle carrier 28 and a nylon web strap 114 is attached to the bottom of the hold portion 108 and to the bottom of the back portion 106. When the water bottle 30 is inserted in the carrier 28, the elastic band 112 encircles the neck of the bottle 30 and the nylon web strap 114 supports the bottom of the water bottle 30 to securely hold the water bottle 30 in the carrier 28 and to prevent the bottle 30 from shifting during movement by the wearer 38.

As shown in FIG. 6, the back surface of the back portion 106 of the carrier 28 has a quick release hook fastener 116, such as a Velcro® material, attached thereto. The flap portion 110 has a complementary Velcro® loop material 118 attached thereto for mating with the Velcro® hook material 116 on the back portion 106 of the carrier 28. When the water bottle carrier 28 is attached to the belt 24, the belt 24 is sandwiched between the flap portion 110 of the carrier 28 and the back portion 106. The Velcro® hook material 116 on the back portion 106 mates with the Velcro® loop material 72 on the outer surface of the belt 24 to securely fasten the carrier 28 to the belt 24. Other than the portion of the Velcro® material which is attached to the belt 24, the Velcro® hook material 116 on the back portion 106 and the Velcro® loop material 118 on the flap portion 110 are mated with each other. The water bottle carrier 28 can be positioned at various positions along the back portion 106 by sandwiching the belt 24 at various positions between the back portion 106 and the flap portion 110. The Velcro® hook and loop prevents the carrier 28 from shifting on the belt 24 during movement by the wearer 38. The water bottle carrier 28 can be easily and quickly removed from the belt 24 by lifting the flap portion 110 and pulling the back portion 106 away from the belt 24.

FIGS. 7 and 8, the cassette tape player carrier 32 for carrying a cassette tape player 34 or the like is shown. The cassette tape player carrier 32 can be selectively attached to the belt 24. The cassette tape player carrier 32 has a flat back wall 120, a flat front wall 122, a bottom wall 124 which separates the back and front walls 120, 122 and a first flap portion 126 which overlays the top of the carrier 32, and extends downwardly over the front wall 122. The first flap portion 126 has a Velcro® material (not shown) thereon which mates with a complementary Velcro® material (not shown) on the front wall 122 of the cassette tape player carrier 32 in order to close the top of the carrier 32.

Elastic side members 132 separate the front wall 122 and the back wall 120. A second flap portion 134 overlays the back wall 120 of the carrier 32. The carrier 32 can hold a cassette tape player 34, portable radio, additional cassette tapes or the like therein. The carrier 34 can be expanded by stretching the elastic side members 132 to separate the front and back walls 122, 120.

As shown in FIG. 8, the back wall 120 of the cassette tape player carrier 32 has a suitable quick release fastener 136, such as a Velcro® hook material, attached thereto. The second flap portion 134 has a complementary Velcro® loop material 138 attached thereto for mating with the Velcro® hook material 136 on the back wall 120 of the cassette tape player carrier 32. When the cassette tape player carrier 32 is attached to the belt 24, the belt 24 is sandwiched between the second flap portion 134 and the back wall 120. The Velcro® hook material 136 on the back wall 120 mates with the Velcro® loop material 72 on the outer surface of the belt 24 to securely fasten the cassette tape player carrier 32 to the belt 24. Other than the portion of the Velcro® hook material which is attached to the belt 24, the Velcro® hook material 136 on the back wall 120 and the Velcro® loop material 138 on the flap portion 134 are mated with each other. The cassette tape player carrier 32 can be positioned at various positions along the back wall 120 by sandwiching the belt 24 at various positions between the back wall 120 and the flap portion 134. The Velcro® hook and loop prevents the cassette tape player carrier 32 from shifting on the belt 24 during movement by the wearer 38. The cassette tape player carrier 32 can be easily and quickly removed from the belt 24 by lifting the second flap portion 134 and pulling the back wall 120 away from the belt 24.

Figure 9:
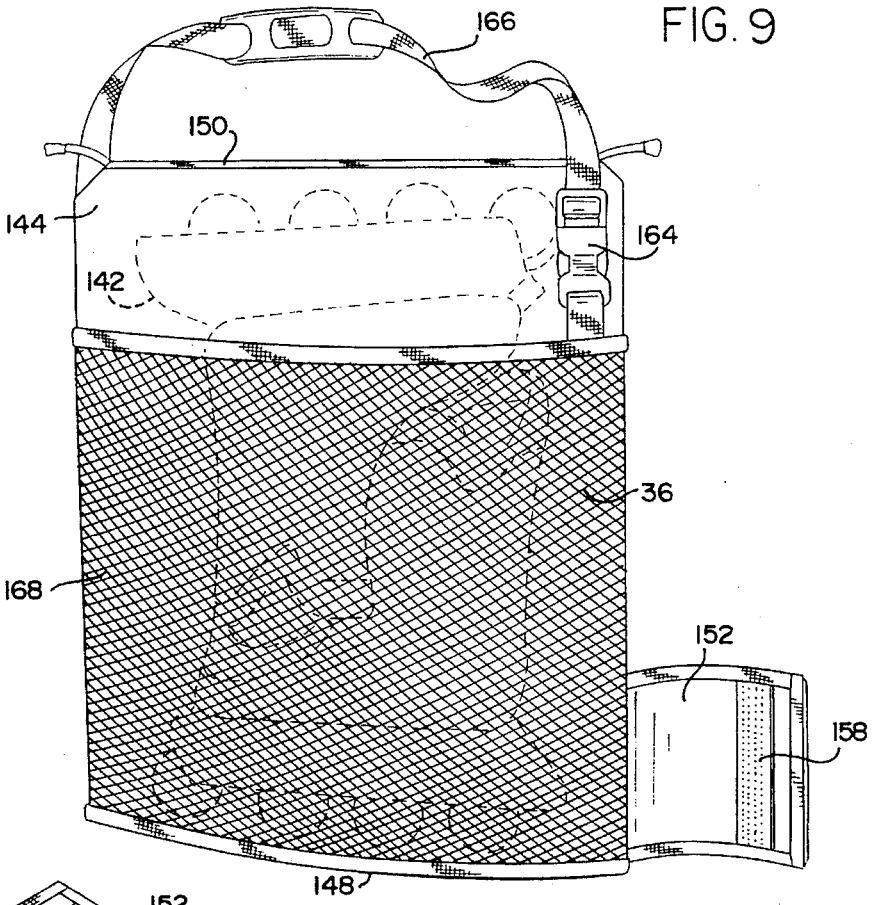
FIG. 9 is a front elevational view of a fold-up bag for carrying in-line skates or the like which may be another component of the belt pack system.
Figure 12:
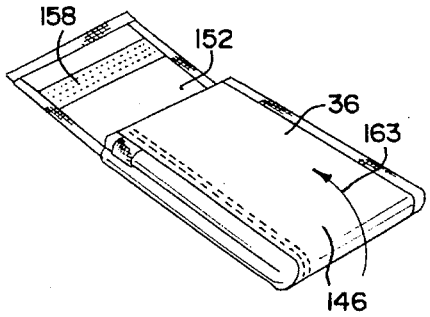
Figure 13:
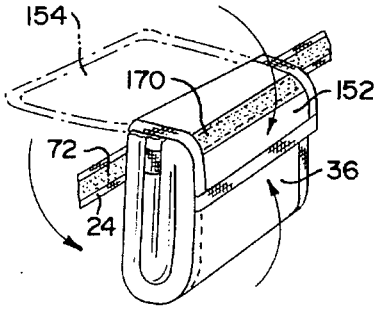

The fold-up bag 36 is shown in FIGS. 9–13. When the fold-up bag 36 is folded, as shown in FIG. 13, it can be attached to the belt 24 and when the fold-up bag 36 is detached from the belt 24 and unfolded, as shown in FIG. 9, the fold-up bag 36 is large enough to hold a pair of in-line skates 142, ski boots or the like. The fold-up bag 36 includes a front wall 144, a back wall 146 and a bottom wall 148. The front and back walls 144, 146 are secured together by suitable means, such as by being sewn, along their sides. The bottom wall 148 is secured to the front and back walls 144, 146 by suitable means, such as being sewn, to form a three-sided compartment. The top of the compartment is closed by a suitable closure means 150, such as a zipper which extends the length between the front and back walls 144, 146.

First and second flap portions 152, 154 are attached to lower exterior portions of the fold-up bag 36. The first flap portion 152, when the fold-up bag 36 is unfolded, has a suitable hook fastener material 158, such as a Velcro® material, thereon which mates with the mesh material on the lower portion of the front wall of the fold-up bag 36. The second flap portion 154 has a Velcro® loop material (not shown) thereon which mates with a complementary Velcro® hook material (not shown) on the lower exterior of the back wall 146 of the fold-up bag 36.

The fold-up bag 36 has suitable release buckles 164 near the top of the fold-up bag 36 for attaching a shoulder strap 166 of known structure thereto so that the fold-up bag 36 can be carried over the shoulder of the wearer 38. This shoulder strap 166 can also be attached to the pack 22 at release buckles 104. The fold-up bag 36 may have a mesh outer wall 168 which forms an outer compartment and is separated from the inner compartment by the front wall 144 of the fold-up bag 36. The mesh outer wall 168 is suitably secured to the sides and the bottom of the front wall 144 to form a three sided enclosure. The mesh wall 168 has a suitable closure, such as a patch or piece of Velcro® hook material which mates with a complementary patch or piece of Velcro® loop material on the front wall 144 of the fold-up bag 36, at its top to close the outer compartment formed thereby.

Figure 10:
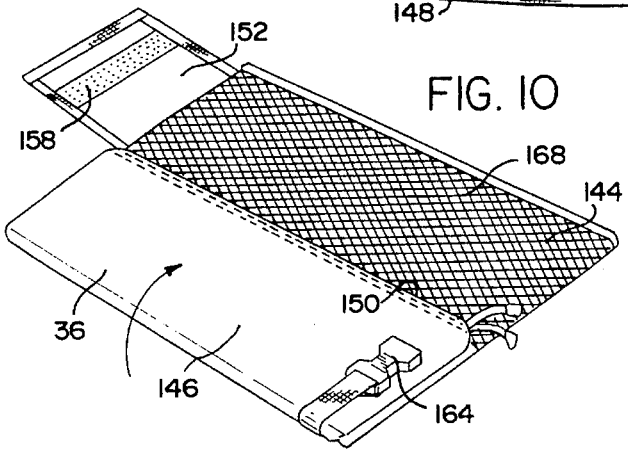
FIGS. 10–13 are perspective views of the fold-up bag for carrying in-line skates or the like illustrating its folding procedure with FIG. 13 showing how the fold-up bag is attached to the belt pack.
Figure 11:
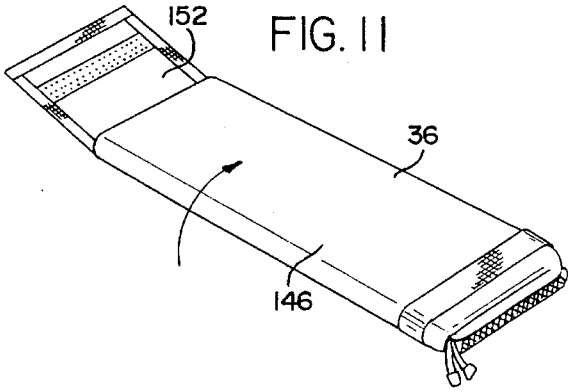

Now that the specifics of the fold-up bag 36 have been described in detail, the method of folding the fold-up bag 36 and attaching the fold-up bag 36 to the belt 24 will be described. First, the fold-up bag 36 is laid flat. As shown in FIG. 10, a first portion of the fold-up bag 36 is folded over onto a second portion along a fold line so that two layers are formed. The first portion which is folded is the portion of the fold-up bag 36 which is at the other end of the fold-up bag 36 from the flap portions 152, 154. Next, as shown in FIG. 11, the two layers are folded over onto a third portion of the fold-up bag 36 along a fold line so that three layers are formed. At this point in the folding process, the fold-up bag 36 has been completely folded over onto itself. Thereafter, as shown in FIG. 12, the three layers are folded onto itself along a fold line, forming six layers altogether, or two layers of the preceding three layer arrangement. Next, the two layers of the three layer arrangement are folded along a fold line in the direction of arrow 163, forming twelve layers, or four layers of the three layer arrangement. The first flap portion 152 is drawn over the open end of the four folded layers of the three layer arrangement, and the hook fastener 158 thereon is attached to the loop fastener material (not shown) on the outside of the lower portion 146 of the fold-up bag 36 to form a small, folded package.

To attach the folded bag 36 to the belt 24, the second flap portion 154 is released from the hook material on the back wall 146 of the bag 36 and folded over the belt 24. The wearer 38 sandwiches the belt 24 between the second flap portion 154 and the back wall 146 of the fold-up bag 36. The hook material on the back wall 146 mates with the loop material 72 on the belt 24 to securely fasten the folded bag 36 to the belt 24. Other than the portion of the loop material which is attached to the belt 24, the hook material on the back wall 146 and the loop material on the second flap portion 154 are mated with each other. The hook and loop prevents the folded bag 36 from shifting on the belt 24 during movement by the wearer 38. The bag 36 can be easily and quickly removed from the belt 24 by lifting the second flap portion 154 and pulling the back wall 146 away from the belt 24.

The water bottle carrier 28, the cassette tape player carrier 32 and the fold-up bag 36 can have reflective material 170 thereon for aiding passerbys in seeing the wearer 138. Preferably, when the water bottle carrier 28, the cassette tape player carrier 32 and the fold-up bag 36 are mounted on the belt 24, the items are placed as near as possible towards the pack 22, and therefore the wearer's small of the back, so that the items have a minimal effect on the wearer's center of gravity. While the water bottle carrier 28, the cassette tape player carrier 32 and the fold-up bag 36 are described herein as being attached to the belt 24, it is to be understood that the items may instead be attached to the compression strap 62. While the pack 22 is shown attached to the belt 24 in the drawings, it is to be understood that the belt 24 may be worn with one or more of the above-described items, the water bottle carrier 28, the cassette tape player carrier 32 and/or the fold-up bag 36, attached thereto without the pack 22 being attached to the belt 24. Furthermore, while the compression strap 62 is shown as a single continuous strap, it is envisioned that two straps may be used, one of each extending from the ladder buckles 66. The illustrated elements which are used to connect the belt 24 to the stabilizer strap 26 could be formed by other means, the intent being creating an attachment point from the stabilizer strap 26 to the belt 24.

While Velcro® hook and loop material is shown in the drawings and used in the description hereinabove, other types of attaching means could be used without departing from the scope of the invention. Such attaching means may be other fasteners such as snaps and the like.

While preferred embodiments of the present invention are shown and described, it is envisioned that those skilled in the art may devise various modifications of the present invention without departing from the spirit and scope of the appended claims. The invention is not intended to be limited by the foregoing disclosure.

The invention claimed is:

1. A belt pack system comprising a pack having a front wall, a rear wall, a top wall, a bottom wall and side walls, said side walls separating the front and rear walls and separating the top and bottom walls, said pack being capable of holding contents therein;

an adjustable length belt connected to said pack, said pack having means thereon for attaching and detaching the belt from said pack, said belt extending around the waist of a wearer and said pack abutting against the small of the back of the wearer when the pack is worn by the wearer; and a pair of adjustable length, three-point stabilizer straps connected to each side of the pack, respectively said pack having means thereon for attaching and detaching each said three-point stabilizer strap from said pack, each said three-point stabilizer strap being connected to each said belt, said three-point stabilizer strap having one end connected to an upper marginal portion of the pack, the other end connected to a lower marginal portion of the pack, and a middle portion connected to the belt.

2. A belt pack system as defined in claim 1, further including at least one of: a water bottle carrier attached to said belt, said water bottle carrier being detachable from said belt, a foldable bag selectively attached to said belt when folded, said foldable bag being detachable from said belt and when detached from said belt and unfolded is large enough to hold a pair of in-line skates or ski boots, or a carrier for carrying items selectively attached to said belt, said carrier being detachable from said belt.

3. A belt pack system as defined in claim 1, wherein said pack has a first compartment within said walls and a second compartment within said walls and separated from the first compartment by a sheet of material, said first compartment being large enough to hold a pair of shoes therein.

4. A belt pack system as defined in claim 3, further including a third compartment comprising an outer wall of mesh material, said outer wall of mesh material being separated from said first and second compartments by a sheet of material which comprises an outer wall of the pack.

5. A belt pack system as defined in claim 1, further including an attachment member attached to said belt for detachably connecting each said three-point stabilizer strap to the belt.

6. A belt pack system as defined in claim 1, further including an adjustable length compression strap having ends connected to generally a midpoint of the rear wall of the pack and extending therefrom along the midpoint of the side walls of the pack and along the midpoint of the front wall of the pack, said compression strap being adjustable to tighten or loosen the compression strap around the pack to prevent the contents of the pack from shifting during movement by the wearer.

7. A belt pack system as defined in claim 6, further including at least one of:

a water bottle attached to the compression strap, said water bottle being detachable from the compression strap, a foldable bag selectively attached to the compression strap when folded, said foldable bag being detachable from the compression strap and when detached from the compression strap and unfolded is large enough to hold a pair of in-line skates or ski boots, or a carrier for carrying items selectively attached to the compression strap, said carrier being detachable from the compression strap.

8. A belt pack system as defined in claim 1, further including a pad and means for attaching the pad to the belt, said pad abutting against the small of the back of the wearer when the pack is worn by the wearer.

9. A belt pack system as defined in claim 1, further including a member made of a relatively stiff material for preventing said pack from collapsing, said member being adjacent to the rear wall of the pack.

10. A belt pack system comprising a pack having a front wall, a rear wall, a top wall, a bottom wall and side walls, said side walls separating the front and rear walls and separating the top and bottom walls; a carrier for holding at least one item; and an adjustable length belt having inner and outer surfaces, said belt having one of a hook fastener element and a loop fastener element on said outer surface thereon for releasably attaching said carrier to said belt; said pack being releasably connected to said belt and said belt extending around the waist of a wearer such that said inner surface abuts the wearer and said pack abutting against the small of the back of the wearer when the pack is worn by the wearer; said carrier including a rear wall and a flap portion connected thereto for folding over said belt, said flap portion having thereon a fastener element the same as that on said belt, said rear wall having the other of said hook fastener element and said loop fastener element thereon for selectively attaching said rear wall of said carrier to said element on said belt and said flap portion to said rear wall of said carrier.

11. A belt pack system as defined in claim 10 wherein said carrier is configured for holding a water bottle.

12. A belt pack system as defined in claim 11, wherein said carrier includes at least one elastic band for securing a water bottle in said carrier.

13. A belt pack system as defined in claim 10 wherein said carrier is configured for holding a cassette tape player.

14. A belt pack system comprising a pack having a front wall, a rear wall, a top wall, a bottom wall and side walls, said side walls separating the front and rear walls and separating the top and bottom walls; a foldable bag which in an unfolded configuration is large enough to hold a pair of in-line skates; and an adjustable length belt, said foldable bag being selectively attached to said belt said belt having one of a hook fastener element and a loop fastener element thereon for releasably attaching said foldable bag to said belt; said pack being releasably connected to said belt and said belt extending around the waist of a wearer and said pack abutting against the small of the back of the wearer when the pack is worn by the wearer; said foldable bag including a rear wall and a flap portion connected thereto for holding over said belt, said flap portion having thereon a fastener element the same as that on said belt, said rear wall having the other of said hook fastener element and said loop fastener element thereon for selectively attaching said rear wall of said foldable bag to said element on said belt and said flap portion to said rear wall of said foldable bag.

* * * * *

UNITED STATES PATENT AND TRADEMARK OFFICE

CERTIFICATE OF CORRECTION

PATENT NO. : 5,570,824
DATED : November 5, 1996
INVENTOR(S) : Scott B. Lyon and Bruce W. Lyon It is certified that error appears in the above-indentified patent and that said Letters Patent is hereby corrected as shown below:

Column 12, Line 4 "holding" should be --folding --

Signed and Sealed this

Eighteenth Day of March, 1997

Bruce Lehman

*Attest:*

BRUCE LEHMAN

*Attesting Officer*

*Commissioner of Patents and Trademarks*